US010563919B2

(12) United States Patent
Won et al.

(10) Patent No.: US 10,563,919 B2
(45) Date of Patent: Feb. 18, 2020

(54) METHOD, SYSTEM, AND APPARATUS FOR CONTROLLING A TEMPERATURE OF A SUBSTRATE IN A PLASMA PROCESSING CHAMBER

(71) Applicant: SEMES CO., LTD., Cheonan-si, Chungcheongnam-do (KR)

(72) Inventors: Jung Min Won, Donghae-si (KR); Ik-Jin Choi, Pyeongtaek-si (KR); Hyo Seong Seong, Changwon-si (KR); Shin-Woo Nam, Yongin-si (KR)

(73) Assignee: SEMES CO., LTD., Cheonan-si (KR)

( * ) Notice: Subject to any disclaimer, the term of this patent is extended or adjusted under 35 U.S.C. 154(b) by 389 days.

(21) Appl. No.: 15/463,319

(22) Filed: Mar. 20, 2017

(65) Prior Publication Data

US 2017/0318627 A1 Nov. 2, 2017

(30) Foreign Application Priority Data

Apr. 29, 2016 (KR) ..... 10-2016-0052941

(51) Int. Cl.
*F27D 7/06* (2006.01)

(52) U.S. Cl.
CPC ..... *F27D 7/06* (2013.01)

(58) Field of Classification Search
CPC . F27D 7/06; F27D 11/00; F27D 11/02; F27D 11/04; F27D 11/08; H05B 3/283; H05B 3/0047; H05B 3/62; H01L 21/67109; H01L 21/67115; H01L 21/67248; H01L 21/67103; H01L 21/67098; H01L 21/6831; H01L 21/3065; H01J 37/32522; H01J 37/32431; H01J 37/32; H01J 37/32724; H01J 37/32733; H01J 37/32743; H01J 37/32761; H01J 37/3277; H01J 37/32799
See application file for complete search history.

(56) References Cited

U.S. PATENT DOCUMENTS

2014/0154819 A1* 6/2014 Gaff ..... H01L 21/67109 438/17

FOREIGN PATENT DOCUMENTS

| | | | |
|---|---|---|---|
| CN | 103854947 | A | 6/2014 |
| CN | 105183031 | A | 12/2015 |
| JP | 2000-306917 | A | 11/2000 |
| JP | 2001-185679 | A | 7/2001 |
| KR | 10-0376879 | B1 | 3/2003 |

(Continued)

*Primary Examiner* — Shawntina T Fuqua
(74) *Attorney, Agent, or Firm* — Harness, Dickey & Pierce, P.L.C.

(57) ABSTRACT

An embodiment includes an apparatus for controlling temperature of a substrate, an apparatus for treating a substrate comprising the same, and a method of controlling the same, which may control the temperature of the substrate by each area and not increasing the volume of the apparatus. The substrate temperature control apparatus comprises: a support plate for supporting a substrate; a plurality of heating units placed in different area of the substrate and controlling a temperature of the substrate by each area; a power supply unit for providing a power to control the temperature of the substrate; a switch unit connected between the plurality of heating units and the power supply unit, and obtaining one or more of a transistor device; and a controller for controlling a power which is supplied to each heating units by controlling unit.

17 Claims, 7 Drawing Sheets

(56) References Cited

FOREIGN PATENT DOCUMENTS

| | | | |
|---|---|---|---|
| KR | 10-2007-0111218 | A | 11/2007 |
| KR | 2014-0070494 | A | 6/2014 |
| KR | 2015-0144722 | A | 12/2015 |
| WO | WO-2006/049085 | A1 | 5/2006 |

* cited by examiner

METHOD, SYSTEM, AND APPARATUS FOR CONTROLLING A TEMPERATURE OF A SUBSTRATE IN A PLASMA PROCESSING CHAMBER

CROSS-REFERENCE TO RELATED APPLICATIONS

This U.S. non-provisional patent application claims priority under 35 U.S.C. § 119 of Korean Patent Application Nos. 10-2016-0052941 filed on Apr. 29, 2016, the entire contents of which are hereby incorporated by reference.

BACKGROUND

This disclosure relates to an apparatus for controlling temperature of a substrate, an apparatus for treating a substrate comprising the same, and a method of controlling the same.

An apparatus for controlling temperature of a substrate is needed in order to control temperature of a substrate while manufacturing semiconductor. Existing substrate temperature control apparatus have controlled each of heating units with a corresponding plurality of controllers. The heating units control temperature of a substrate by each areas of the substrate.

However, with an arising substrate including a multi zone requires more than hundreds of heating units, and when a controller corresponding to the heating units is included; it requires at least thirty times bigger apparatus than the existing apparatus. This retrogress the current trend of reducing the volume of the apparatus.

Therefore, a technic to control the temperature of a substrate having a multi zone and not increasing the volume of an apparatus is required,

SUMMARY

An embodiment includes an apparatus for controlling temperature of a substrate, an apparatus for treating a substrate comprising the same, and a method of controlling the same, which may control the temperature of the substrate by each area and not increasing the volume of the apparatus.

The objects of the inventive concept are not limited to the above descriptions. Other objects thereof will be understandable by those skilled in the art from the following descriptions.

Example embodiments of the inventive concept may provide a substrate temperature control apparatus comprising: a support plate for supporting a substrate; a plurality of heating units placed in different area of the substrate and controlling a temperature of the substrate by each area; a power supply unit for providing a power to control the temperature of the substrate; a switch unit connected between the plurality of heating units and the power supply unit, and including one or more transistor devices; and a controller for controlling a power which is supplied to each healing units by controlling the switch unit.

In example embodiments, the transistor device may include MOSFET device.

In example embodiments, the switch unit may include a plurality of MOSFET channels corresponding to the plurality of heating units, respectively.

In example embodiments, the controller may selectively turn on the plurality of MOSFET channels.

In example embodiments, the substrate temperature control apparatus may further comprise a sensor unit for detecting temperature distribution information of the substrate.

In example embodiments, the controller may determine which MOSFET channel to turn on depending on the temperature distribution information.

In example embodiments, the substrate temperature control apparatus may further comprise: a first filter connected between the power supply unit and the switch unit, and blocking high-frequency power signal which flows into the power supply unit; and a second filter arranged between the switch unit and the controller, and blocking high-frequency power signal flows which into the controller.

In example embodiments, the second filter may include a ferrite core.

In example embodiments, the power supply unit may provide an alternating current power.

In example embodiments, the power supply unit may provide an alternating current power below predetermined frequency. The first filter and the second filter may block a high-frequency power signal above predetermined frequency and may pass a high-frequency power signal below predetermined frequency.

Example embodiments of the inventive concept may provide a substrate treating apparatus comprising: a chamber for providing a substrate treating space therein; a substrate support assembly for supporting the substrate and placed within the chamber; a gas supply unit for supplying a gas within the chamber; a plasma generating unit for making the gas into a plasma state, and including a high-frequency power source for supplying high-frequency power; and a substrate temperature control unit for controlling a temperature of the substrate, wherein the substrate temperature control unit may comprise: a plurality of heating units placed in different area of the substrate and controlling a temperature of the substrate by each area; a power supply unit for providing a power to control the temperature of the substrate; a switch unit connected between the plurality of heating units and the power supply unit, and including one or more of a transistor device; and a controller for controlling a power which is supplied to each heating units by controlling the switch unit.

In example embodiments, the transistor device may include MOSFET device.

In example embodiments, the switch unit may include a plurality of MOSFET channels corresponding to the plurality of heating units, respectively. The controller may selectively turn on the plurality of MOSFET channels.

In example embodiments, the substrate temperature control unit may further comprise a sensor unit for detecting temperature distribution information of the substrate. The controller may determine which channel to turn on depending on the temperature distribution information.

In example embodiments, the substrate temperature control unit may further comprise: a first filter connected between the power supply unit and the switch unit, and blocking high-frequency power signal flows into the power supply unit; and a second filter arranged between the switch unit and the controller, and blocking high-frequency power signal flows into the controller.

In example embodiments, the second filter may include a ferrite core.

In example embodiments, the power supply unit may provide an alternating current power.

In example embodiments, the power supply unit may provide an alternating current power below predetermined frequency. The first filter and the second filter may block a high-frequency power signal above predetermined frequency and may pass a high-frequency power signal below predetermined frequency.

Example embodiments of the inventive concept may provide a method to control substrate treating apparatus comprising: detecting temperature distribution information of the substrate including plurality areas; and controlling the switch unit based on the temperature distribution information.

In example embodiments, controlling the switch unit based on the temperature distribution information may comprise: determining an area to provide a power based on the temperature distribution information; and turning on MOSFET channel corresponding to a determined area of the substrate.

In example embodiments, controlling the switch unit based on the temperature distribution information may comprise: determining an area to provide a power based on the temperature distribution information; and applying different signals to a MOSFET gate corresponding to the determined area of the substrate, and the rest of the MOSFET gates corresponding to the rest of the determined areas.

Embodiments of the inventive concepts may provide a substrate temperature control apparatus and may control the temperature of the substrate by each area and not increasing the volume of the apparatus.

The objects of the inventive concept are not limited to the above descriptions. Other effects thereof will be understandable by those skilled in the art from the following descriptions and drawings.

DETAILED DESCRIPTION OF THE EMBODIMENTS

Advantages and features of the present inventive concept, and implementation methods thereof will be clarified through following embodiments described with reference to the accompanying drawings. The present inventive concept may, however, be embodied in different forms and should not be construed as limited to the embodiments set forth herein. Rather, these embodiments are provided so that this disclosure will be thorough and complete, and will fully convey the scope of the present invention to those skilled in the art. Further, the present inventive concept is only defined by scopes of claims.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Figure 1:
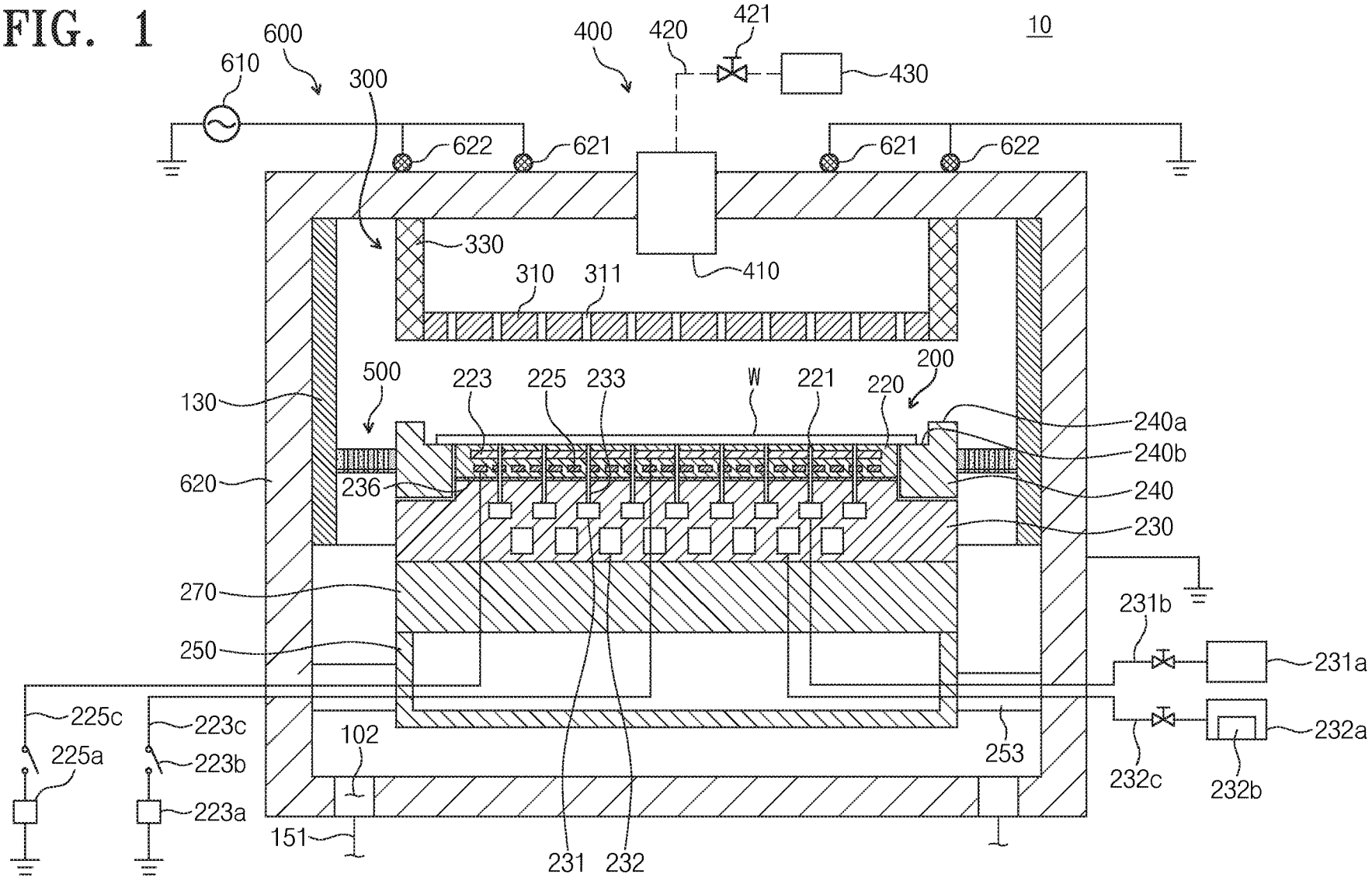
FIG. 1 is an exemplary drawing illustrating a substrate treating apparatus according to an embodiment.

FIG. 1 is an exemplary drawing illustrating a substrate treating apparatus according to an embodiment.

Referring to FIG. 1, a substrate treating apparatus 10 treats the substrate W using plasma. For example, the substrate treating apparatus 10 may perform an etching process with respect to the substrate W. The substrate treating apparatus 10 may include a chamber 620, a substrate support assembly 200, a shower head 300, a gas supply unit 400, a baffle unit 500, and a plasma generating unit 600.

The chamber 620 may provide a space for performing a process for treating a substrate therein. The chamber 620 may have treating space therein and may be provided as a sealed form. The chamber 620 may be provided with a metal material. The chamber 620 may be provided with an aluminum material. The chamber 620 may be grounded. An exhaust hole 102 may be formed on a bottom surface of the chamber 620. The exhaust hole 102 may be connected to an exhaust line 151. A reaction by-product generated in a process step and a gas which exists in an internal space of the chamber may be discharged through the exhaust line 151. The internal space of the chamber 620 may be decompressed to a predetermined compression by an exhaust process.

In an embodiment, a liner 130 may be provided in the chamber 620. The liner 130 may have a cylinder shape where a top end portion and a bottom end portion are opened. The liner 130 may be provided to contact with an inner sidewall of the chamber 620. The liner 130 may protect the inner sidewall of the chamber 620, thereby making it possible to prevent the inner sidewall of the chamber 620 from the arc discharge. Furthermore, the liner 130 may prevent impurities generated during a process for treating a substrate from being deposited on the inner sidewall of the chamber 620. Selectively, the linear 130 may not be provided.

The substrate support assembly 200 may be located in the chamber 620. The substrate support assembly 200 may support the substrate W. The substrate support assembly 200 may include an electrostatic chuck 210 for holding the substrate W using an electrostatic force. On the other hand, the substrate support assembly 200 may support the substrate W in various methods such as a mechanical clamping. The substrate support assembly 200 including the electrostatic chuck 210 may be described as follows.

The substrate support assembly 200 may include an electrostatic chuck 210, a bottom cover 250 and a plate 270.

The substrate support assembly 200 may be installed to be apart from the bottom surface of the chamber 620 in the chamber 620.

The electrostatic chuck 210 may include a dielectric plate 220, a body 230, and a focus ring 240. The electrostatic chuck 210 may support the substrate W. The dielectric plate 220 may be located on the electrostatic chuck 210. The dielectric plate 220 may be a dielectric substance having a circular shape. The substrate W may be placed on an upper surface of the dielectric plate 220. A radius of the upper surface of the dielectric plate 220 may have a smaller than that of the substrate W. Thereby, a boundary area of the substrate W may be located outside the dielectric plate 220.

The dielectric plate 220 may include a first electrode 223, a heating unit 225, and a first supply path 221. The first supply path 221 may be provided from an upper side of the dielectric plate 220. The first supply path 221 may include a plurality of paths which are spaced apart from each other, and be used as a path through which heat transmission media is supplied to a bottom surface of the substrate W.

The first electrode 223 may be electrically connected with a first power 223*a*. The first power 223*a* may include a direct current. A switch 223*b* may be installed between the first electrode 223 and the first power 223*a*. The first electrode 223 may be electrically connected to the first power 223*a* in response to activation of the switch 223*b*. When the switch 223*b* is turned on, the direct current may be applied to the first electrode 223. An electrostatic force generated by a current applied to the first electrode 223 may operate between the first electrode 223 and the substrate W. The substrate may be held on the dielectric plate 220 by the electrostatic force.

The heating unit 225 may be located at the bottom of the first electrode 223. The heating unit 225 may be electrically connected to a second power 225*a*. The heating unit 225 may generate heat by resisting a current from the second power 225*a*. The heat may be transmitted to the substrate W through the dielectric plate 220. The substrate W may maintain predetermined temperature by the heat generated from the heating unit 225. The heating unit 225 may include a helical coil.

The body 230 may be located under the dielectric plate 220. A bottom surface of the dielectric plate 220 and a top surface of the body 230 may be adhered by an adhesive 236. The body 230 may be made of aluminum material. The center area of the top surface of the body 230 may be higher than a boundary area. The center area of the top surface of the body 230 may correspond to the bottom surface of the dielectric plate 220 and may be adhered to the bottom surface of the dielectric plate 220. A first circulation path 231, a second circulation path 232 and a second supply path 233 may be formed in the body 230.

The first circulation path 231 may be used as a path which heat transmission media is circulated. The first circulation path 231 may be formed in the body 230 in a helical shape. Or, the first circulation path 231 may include ring-shaped paths having different radius. The paths may be arranged such that centers of the paths have the same height. The first circulation paths 231 may be connected with each other. The first circulation paths 231 may be formed at the same height.

The second circulation path 232 may be used as a path where cooling fluid is circulated. The second circulation path 232 may be formed in the body 230 in a helical shape. Or, the second circulation path 232 may include ring-shaped paths having different radius. The paths may be arranged such that centers of the paths have the same height. The second circulation paths 232 may be connected with each other. The second circulation path 232 may have a cross-sectional area larger than the first circulation path 231. The second circulation path 232 may be formed at the same height. The second circulation path 232 may be located under the first circulation path 231.

The second supply path 233 may extend upward from the first circulation path 231 acid may be provided on the body 230. The number of the second supply path 233 may correspond to that of paths of the first supply path 221. The second supply path 233 may connect the first circulation path 231 and the first supply path 221.

The first circulation path 231 may be connected to heat transmission media storage unit 231*a* via a supply line 231*b*. The heat transmission media storage unit 231*a* may store heat transmission media. The heat transmission media may include an inert gas. In an embodiment, the heat transmission media may include a helium gas. The helium gas may be supplied to the first circulation path 231 via the supply line 231*b*. Moreover, the helium gas may be supplied to the bottom surface of the substrate W through the second supply path 233 and the first supply path 221. The helium gas may be a media through which heat transmitted from plasma to the substrate W is transmitted to the electrostatic chuck 210.

The second circulation path 232 may be connected to a cooling fluid storage unit 232*a* via a cooling fluid supply line 232*c*. The cooling fluid storage unit 232*a* may store cooling fluid. The cooling fluid storage unit 232*a* may include a cooler 232*b*. The cooler 232*b* may lower a temperature of the cooling fluid. On the other hand, the cooler 232*b* may be installed on the cooling fluid supply line 232*c*. The cooling fluid supplied to the second circulation path 232 via the cooling fluid supply line 232*c* may circulate along the second circulation path 232, thereby making it possible to cool the body 230. As cooled, the body 230 may cool both the dielectric plate 220 and the substrate W to allow the substrate W to remain at a predetermined temperature.

The body 230 may include a metal plate. In an embodiment, entire body 230 may be provided with a metal plate.

The focus ring 240 may be arranged in a boundary are of the electrostatic chuck 210. The focus ring 240 may have a ring shape and be arranged along a circumstance of the dielectric plate 220. A top surface of the focus ring 240 may be installed such that an outer top surface 240*a* is higher than an inner top surface 240*b*. The inner top surface 240*b* of the focus ring 240 may be located at the same height as a top surface of the dielectric plate 220. The inner op surface 240*b* of the focus ring 240 may support a boundary area of the substrate W located outside the dielectric plate 220. The outer top surface 240*a* of the focus ring 240 may surround the boundary area of the substrate W. The focus ring 240 may control an electromagnetic field so that the density of plasma may be equally dispersed throughout the substrate W. According to this, plasma may equally form throughout the entire area of the substrate W, thereby equally etching each area of the substrate W.

The bottom cover 250 may be located under the substrate support assembly 200. The bottom cover 250 may be installed to be spaced apart from the bottom surface of the chamber 620. The bottom cover 250 may include a space 255 where a top surface is opened. An outer radius of the bottom cover 270 may be equal to an outer radius of the body 230. A left pin module (not shown) for moving the substrate W to be returned from an outside return element to the electrostatic chuck 210 may be located in the inner space 255 of the bottom cover 250. The left pin module (not shown) may be located to be spaced apart from the bottom cover 250.A bottom surface of the bottom cover 250 may be made of a metal material. The inner space 255 of the cover 250 may be provided with air. As the air has lower permittivity than insulation it may lower electromagnetic field within the substrate support assembly 200.

The bottom cover 250 may have a connection element 253. The connection element 253 may connect an outer sidewall of the bottom cover 250 and an inner sidewall of the chamber 620. The connection element 253 may include a plurality of connection elements which are placed i.e. space apart from the outer sidewall of the bottom cover 270. The connection element 253 may support the substrate support assembly 220 in the chamber 620. Further, the connection element 253 may be connected to the inner sidewall of the chamber 620, thereby making it possible for the bottom cover 250 to be electrically grounded. A first power line 223*c* connected to a first power 223*a*, a second power line 225*c* connected to a second power 225*a*, the heat transmission media supply line 231*b* connected to the heat transmission media storage unit 231*a*, and the cooling fluid supply line 232*c* connected to the cooling fluid storage unit 232*a* may be extended into the bottom cover 250 through the inner space 255 of the connection element 253.

A plate 270 may be located between the electrostatic chuck 210 and the bottom cover 250. The plate 270 may cover upper surface of the bottom cover 250. A cross-sectional area of the plate 270 may correspond to the body 230. The plate 270 may include an insulator. In an embodiment, the plate 270 may be provided with one or a plurality of numbers. The plate 270 may increase electrical distance between the body 230 and the bottom cover 250.

The shower head 300 may be placed on top side of the substrate support assembly 200 in the chamber 620. The shower head 300 may be opposed to the substrate support assembly 200.

The shower head 300 may include a gas disperse plate 310 and a supporter 330. The gas disperse plate 310 may be placed to be spaced apart from the upper surface of the chamber 620. A regular space may be formed between the gas disperse plate 310 and the upper surface of the chamber 620. The gas disperse plate 310 may be provided with a plate form having constant thickness. A bottom surface of the gas disperse plate 310 may be polarized to prevent arc discharge generated by plasma. A cross-section of the gas disperse plate 310 may have the same form and a cross-section area with the substrate support assembly 200. The gas disperse plate 310 may include a plurality of discharge holes 311. The discharge hole 311 may penetrate the gas disperse plate 310 vertically. The gas disperse plate 310 may include metal material.

The supporter 330 may support a lateral end of the gas disperse plate 310. A top end of the supporter 330 may be connected to upper surface of the chamber 620 and a bottom end of the supporter 330 may be connected to the lateral end of the gas disperse plate 310. The supporter 330 may include nonmetal material.

The gas supply unit 400 may provide a process gas into the chamber 620. The gas supply unit 400 may include a gas supply nozzle 410, a gas supply line 420, and a gas storage unit 430. The gas supply nozzle 410 may be installed in a center area of the chamber 620. An injection nozzle may be formed on a bottom surface of the gas supply nozzle 410. The injection nozzle may provide a process gas into the chamber 620. The gas supply line 420 may connect the gas supply nozzle 410 and the gas storage unit 430. The gas supply line 420 may provide a process gas stored in the gas storage unit 430 to the gas supply nozzle 410. A valve 421 may be installed on the gas supply line 420. The valve 421 may turn on or off the gas supply line 420 and adjust the amount of process gas supplied via the gas supply line 420.

The baffle unit 500 may be installed between inner sidewall of the chamber 620 and the substrate support assembly 200. A baffle 510 may be a ring shape. A plurality of penetration holes 511 may be formed in the baffle 510. A process gas provided in the chamber 620 may be exhausted to an exhaust hole 102 through penetration holes 511 of the baffle 510. A flow of the process gas may be controlled depending on shapes of the baffles 510 and penetration holes 511.

The plasma generating unit 600 may make a process gas in the chamber 620 into a plasma state. In an embodiment, the plasma generating unit 600 may be implemented in an ICP-type. In this case, as shown in FIG. 1, the plasma generation unit 600 may include a high-frequency power source 610 for supplying high-frequency power and, a first coil 621 and a second coil 622 electrically connected to the high-frequency power and receiving high-frequency signal.

The first coil 621 and the second coil 622 may be symmetrical to the substrate W. For example, the first coil 621 and the second coil 622 may be installed in top side of the chamber 620. The first coil 621 has smaller diameter than a diameter of the second coil 622, thereby it may be placed inner top side of the chamber 620, and the second coil 622 may be placed outer top side of the chamber 620. The first coil 621 and the second coil 622 may receive high-frequency signal from the high-frequency power source 610 and induce time-varying magnetic field to the chamber, thereby the process gas provided in the chamber 620 may be made into a plasma state.

A process for treating a substrate using described substrate treating apparatus may be described as follows.

When the substrate W is placed on the substrate support assembly 200, a direct current may be applied to the first electrode 223 from the first power 223*a*. An electrostatic force generated by a direct current to the first electrode 223 may operate between the first electrode 223 and the substrate W. The substrate may be held on the electrostatic chuck 210 by the electrostatic force.

When the substrate W is held on the electrostatic chuck 210, a process gas may be provided in the chamber 620 through gas supply nozzle 410. The process gas may be equally dispersed to inner area of the chamber 620 through the discharge hole 311 of the shower head 300. A high-frequency power generated on the high-frequency power source may be applied to a plasma source and thereby an electromagnetic force may be generated in the chamber 100. The electromagnetic force may make a process gas between the substrate support assembly 200 and the shower head 300 into a plasma state. Plasma may be provided to the substrate W and treat the substrate W. Plasma may perform etching process.

Figure 2:
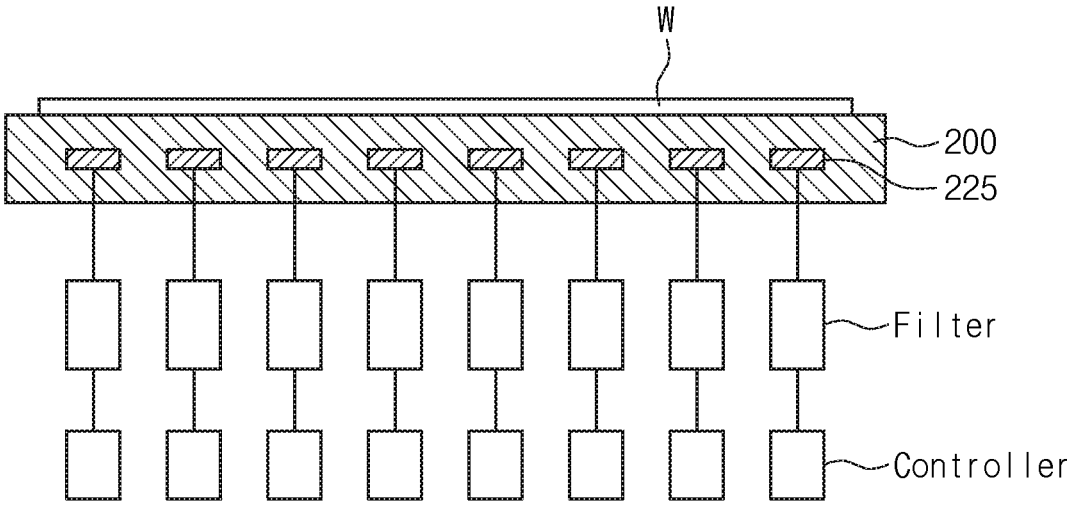
FIG. 2 is a drawing to explain a problem of a substrate temperature control apparatus according to a prior art.

FIG. 2 is a drawing to explain a problem of a substrate temperature control apparatus according to a prior art. As described in FIG. 2, when the heating units and controllers, which correspond to each substrate areas, are needed, a volume of the apparatus has increased. Also, a filter required to block high-frequency power in the heating unit is expensive, thereby it was inefficient.

Figure 3:
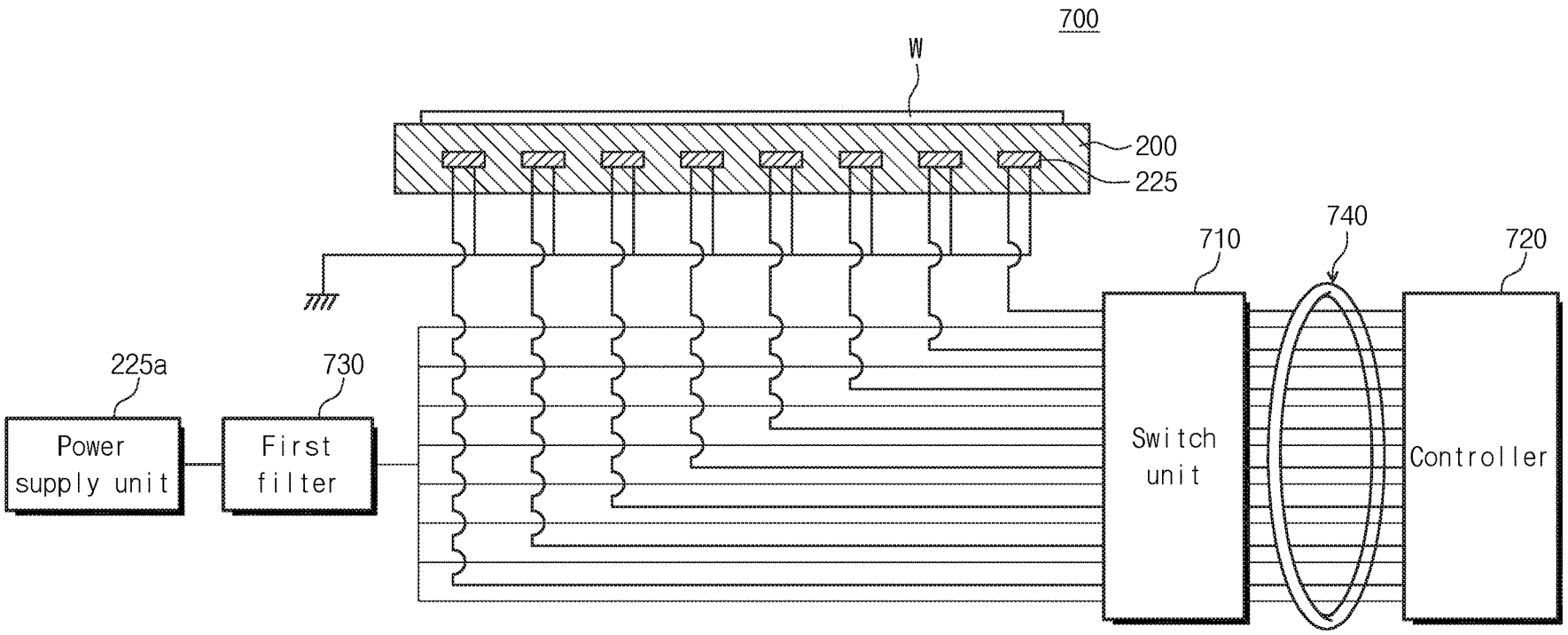
FIG. 3 is an exemplary drawing illustrating a substrate temperature control unit according to an embodiment.

FIG. 3 is a schematic diagram illustrating a substrate temperature control unit 700 according to an embodiment.

Referring to FIG. 3, the substrate temperature control unit 700 includes a support plate 200, a heating unit 225, a power supply unit 225*a*, a switch unit 710, and a controller 720.

The support plate 200 supports the substrate W. A plurality of heating units 225 are placed in different areas of the support plate 200 and control the temperature of the substrate W.

The power supply unit 225*a* provides a power to control the temperature of the substrate. In an embodiment, the power supply unit 225*a* may provide AC power.

The switch unit 710 is connected between the power supply unit 225*a* and the heating unit 225. In an embodiment, the switch unit 710 may include one or more transistor device. The transistor device may be MOSFET or BJT (Bipolar Junction Transistor). Hereinafter explain the switch unit 710 composed of MOSFET.

The controller 620 controls the switch unit 710 thereby controlling each areas of the plurality of substrate areas. The switch unit 710 may include a plurality of MOSFET channels corresponding to the plurality of heating units, respectively. The controller 620 may selectively turn on the plurality of MOSFET channels.

In an embodiment, the substrate temperature control unit 700 may further comprise a sensor unit (not described) for detecting temperature distribution information of the substrate. The controller 710 may heat or cool each area depending on the temperature distribution information. The controller 710 may turn on MOSFET channel corresponding to a substrate area which will be heated. The controller 710 may turn off MOSFET channel corresponding to a substrate area which will be cooled.

Comparing to FIGS. 2 and 3, the prior apparatus required controllers and filters in each areas but according to an embodiment of the present concept, a number of power supply unit 225*a*, a controller 720, and a filter 730 may be decreased using the switch unit 710.

Again referring to FIG. 3, the substrate temperature control unit 700 may include a first filter 730 and a second filter 740.

The first filter 730 may be connected between the power supply unit 225*a* and the switch unit 710. In order to prevent coupling generated as the high-frequency power which is required during plasma process flows into the power supply unit 225*a*, the first filter 730 may block high-frequency power signal which flows into the power supply unit 225*a*.

In an embodiment, the first filter 730 may be a band-pass filter or band-reject filter. For example, the first filter 730 may include adjustable capacitor or adjustable inductor.

The second filter 740 may be arranged between the switch unit 710 and the controller 720. The second filter 740 may also block high-frequency power signal and prevent high-frequency power flowing into the controller 720.

In an embodiment, the second filter 740 may include a ferrite core. The ferrite core may be installed around a wire connecting the switch unit 710 and the controller 720, thereby it may block high-frequency power signal.

The first and second filters 730, 740 block high-frequency power signal but may pass alternating current power signal which is provided from the power supply unit 225*a*. According to an embodiment, the first filter 730 and the second filter 740 may block high-frequency power signal which exceeds predetermined frequency, and pass alternating current power signal which is less than the predetermined frequency.

Figure 4:
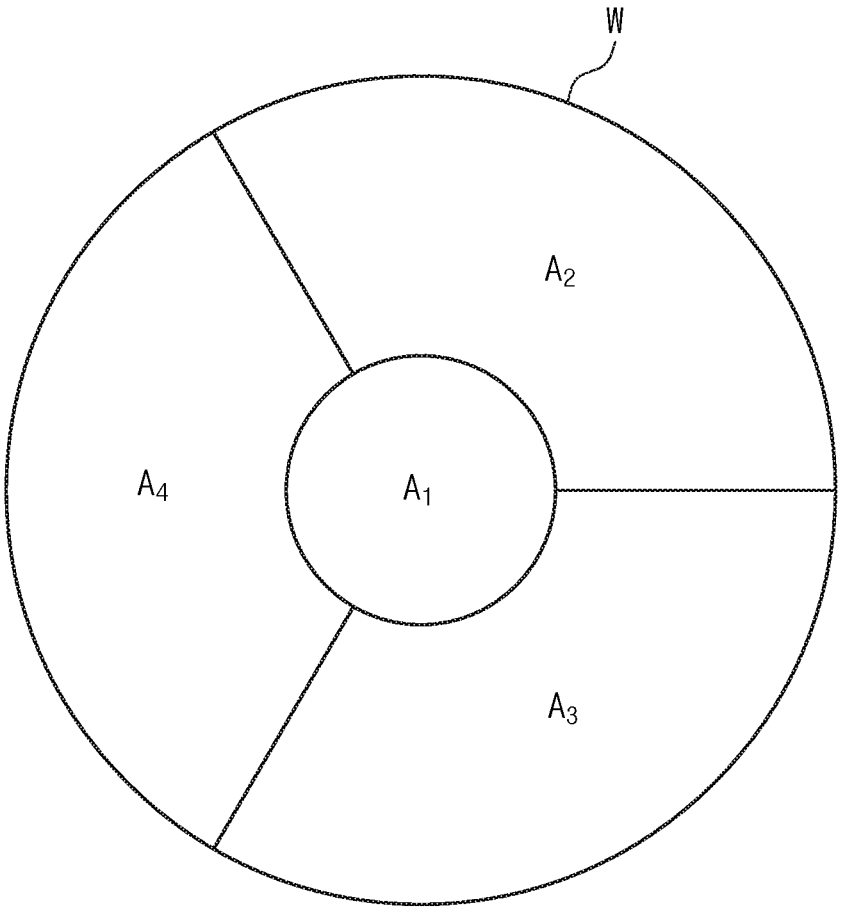
FIGS. 4 and 5 are drawings to explain a method to control temperature of a substrate W having a plurality of areas according to an embodiment.
Figure 5:
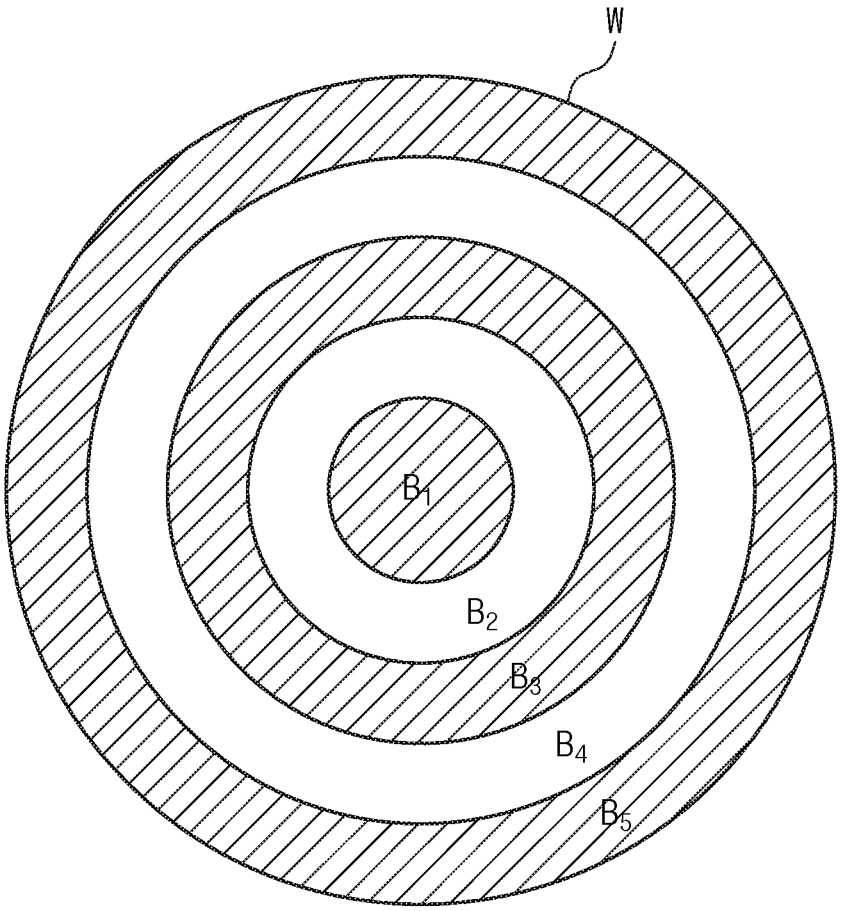

FIGS. 4 and 5 are drawings to explain a method to control temperature of a substrate W having a plurality of areas according to an embodiment.

Referring to FIG. 4, the substrate W may include a first area A1, a second area A2, a third area A3, and a fourth area A4. When an error between each area and each predetermined target temperature is A1>A2>A3 depending on the temperature distribution of the substrate, and the error of A3 is 0, the controller 720 may turn on MOSFET channel which corresponds to the first area and the second area, and receive power. Also, the controller 720 may lengthen a time of turning on the MOSFET channel in the first area which has bigger error.

Referring to FIG. 5, the substrate W may include a plurality of areas B1, B2, B3, B4, B5 divided along the circumference of the substrate W. When controlling the plurality of areas, each surface gets bigger further apart from the center (B1<B2<B3<B4<B4 <B5), thus the controller 720 may lengthen a time of turning on the MOSFET channel which correspond to each area.

Figure 6:
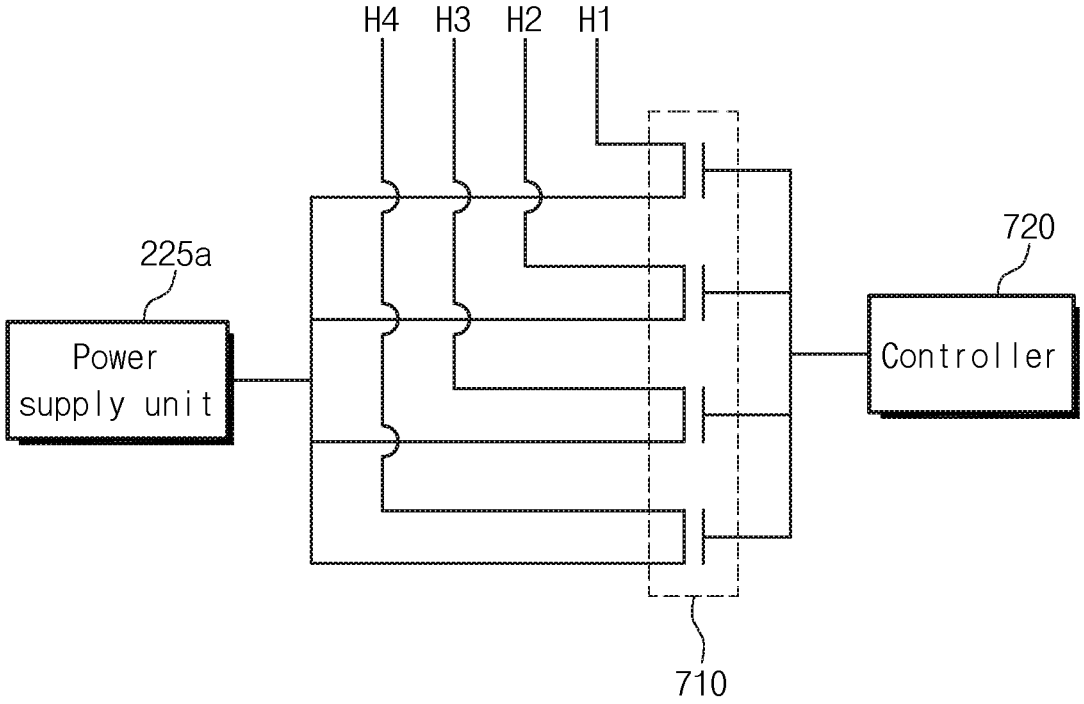
FIG. 6 a drawing to explain operation of a substrate temperature control unit according to an embodiment.

FIG. 6 a drawing to explain operation of a substrate temperature control unit according to an embodiment.

Referring to FIG. 6, the substrate temperature control unit may control temperature of a plurality of substrate areas H1, H2, H3, H4, individually. The controller 72.0 may provide a signal to a gate of MOSFET device and determine whether each substrate area will receive a power from the power supply unit 225*a*, or block the power supply unit 225*a* . MOSFET may be turned on/off quickly so the controller 720 may control each temperature of a plurality of substrate areas efficiently.

Figure 7:
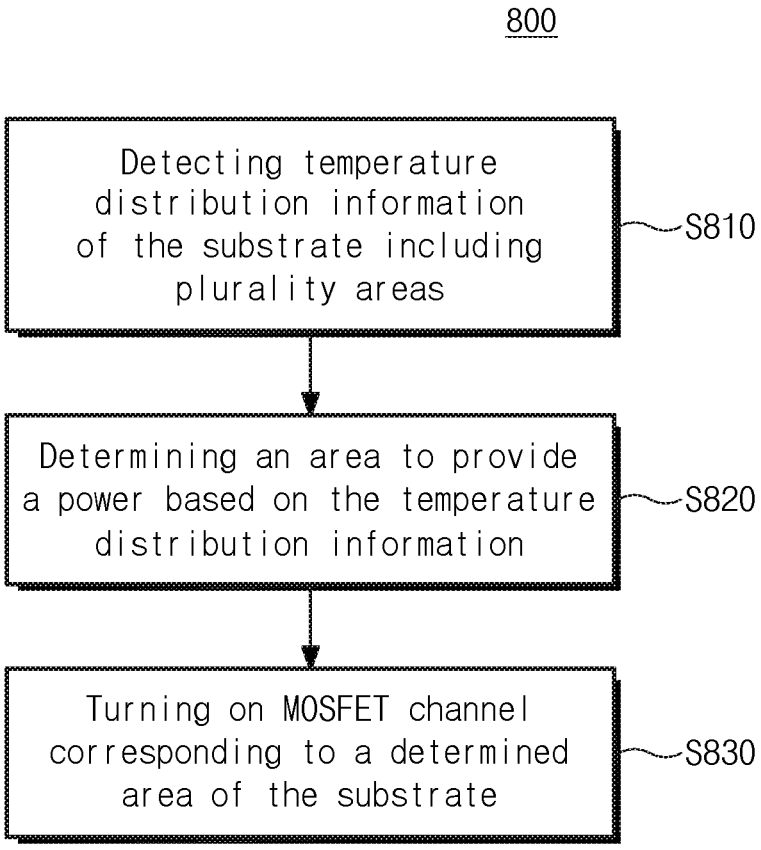
FIG. 7 is an exemplary flow chart illustrating a method to control substrate treating apparatus according to an embodiment.

FIG. 7 is an exemplary flow chart illustrating a method 800 to control substrate treating apparatus according to an embodiment Referring to FIG. 7, the substrate treating apparatus controlling method 800 comprises: detecting temperature distribution information of the substrate including plurality areas S810; determining which MOSFET channel to turn on based on the temperature distribution information S820; and controlling multi-MOSFET based on the determination of the controller S830. The controller may selectively apply a signal to MOSFET gate and control temperature of a plurality of substrate areas by each areas.

The above substrate temperature controlling method may be included in a computer program and performed with an application, and stored in the computer readable recording medium.

The computer readable recording medium may be volatile memory: SRAM (Static RAM), DRAM (Dynamic RAM), SDRAM (Synchronous DRAM) or nonvolatile memory: ROM (Read Only Memory), PROM (Programmable ROM), EPROM (Electrically Programmable ROM), EEPROM (Electrically Erasable and Programmable ROM), flash memory, PRAM (Phase-change RAM), MRAM (Magnetic RAM), PRAM (Resistive RAM), FRAM (Ferroelectric RAM), or floppy disk, or hard disk, or optical reader such as CD-ROM, DVD but not limited herein.

The foregoing detailed descriptions may be merely examples of the embodiments. Further, the above contents merely illustrate and describe preferred embodiments and other embodiments may include various combinations, changes, and environments. That is, it will be appreciated by those skilled in the art that substitutions, modifications and changes may be made in these embodiments without departing from the principles and spirit, the scope of which is defined in the appended claims and their equivalents. Further, it is not intended that the scope of this application be limited to these specific embodiments or to their specific features or benefits. Rather, it is intended that the scope of this application be limited solely to the claims which now follow and to their equivalents.

What is claimed is:

1. A substrate temperature control apparatus comprising: a support plate configured to support a substrate;

a plurality of heating units placed on different areas of the substrate, each of the plurality of heating units configured to control a temperature of the substrate on the different areas;

a power supply unit configured to provide power to control the temperature of the substrate;

a switch unit connected to the plurality of heating units and the power supply unit, the switch unit including one or more transistor devices;

a controller configured to control the power supplied to each of the plurality of heating units from the power supply unit by controlling the switch unit;

a first filter connected to the power supply unit and the switch unit, the first filter configured to block a high-frequency power signal from flowing into the power supply unit; and a second filter connected to the switch unit and the controller, the second filter configured to block a high-frequency power signal from flowing into the controller.

2. The substrate temperature control apparatus of claim 1, wherein the one or more transistor devices includes one or more MOSFET devices.

3. The substrate temperature control apparatus of claim 2, wherein the switch unit includes a plurality of MOSFET channels corresponding to the plurality of heating units; and the controller is further configured to selectively turns on the plurality of MOSFET channels.

4. The substrate temperature control apparatus of claim 3, wherein the substrate temperature control apparatus further comprises at least one sensor unit configured to detect temperature distribution information of the substrate; and the controller is further configured to determines which MOSFET channel to turn on based on the temperature distribution information.

5. The substrate temperature control apparatus of claim 1, wherein the second filter includes a ferrite core.

6. The substrate temperature control apparatus of claim 1, wherein the power supply unit is further configured to provide an alternating current power.

7. The substrate temperature control apparatus of claim 6, wherein the power supply unit is further configured to provides an alternating current power below a predetermined frequency; and the first filter and the second filter are each configured to block a high-frequency power signal that is above the predetermined frequency, and pass a high-frequency power signal that is below the predetermined frequency.

8. A substrate treating apparatus comprising:

a chamber configured to provide a substrate treating space therein;

a substrate support assembly configured to support the substrate, the substrate support assembly placed within the chamber;

a gas supply unit configured to supply a gas within the chamber;

a plasma generating unit configured to change the gas into a plasma state, the plasma generating unit including a high-frequency power source configured to supply high-frequency power; and a substrate temperature control unit configured to control a temperature of the substrate, and the substrate temperature control unit includes, a plurality of heating units placed in different areas of the substrate, the plurality of heating units each configured to control a temperature of the substrate on the different areas;

a power supply unit configured to provide power to control the temperature of the substrate;

a switch unit connected to the plurality of heating units and the power supply unit, the switch unit including one or more transistor devices;

a controller configured to control the power supplied to each of the plurality of heating units from the power supply unit by controlling the switch unit;

a first filter connected to the power supply unit and the switch unit, the first filter configured to block a high-frequency power signal from flowing into the power supply unit; and a second filter connected to the switch unit and the controller, the second filter configured to block a high-frequency power signal from flowing into the controller.

9. The substrate treating apparatus of claim 8, wherein the one or more transistor devices includes one or more MOSFET devices.

10. The substrate treating apparatus of claim 9, wherein the switch unit includes a plurality of MOSFET channels corresponding to the plurality of heating units; and the controller is further configured to selectively turns on the plurality of MOSFET channels.

11. The substrate treating apparatus of claim 8, wherein the substrate temperature control unit further comprises a sensor unit configured to detect temperature distribution information of the substrate; and the controller is further configured to determines which channel to turn on based on the temperature distribution information.

12. The substrate treating apparatus of claim 8, wherein the second filter includes a ferrite core.

13. The substrate treating apparatus of claim 8, wherein the power supply unit is further configured to provides an alternating current power signal.

14. The substrate treating apparatus of claim 13, wherein the power supply unit is further configured to provides an alternating current power below a predetermined frequency; and the first filter and the second filter are each configured to block a high-frequency power signal above the predetermined frequency, and pass a high-frequency power signal below the predetermined frequency.

15. A method to control a substrate treating apparatus comprising:

detecting temperature distribution information of a substrate including a plurality areas; and controlling a switch unit based on the temperature distribution information, wherein the substrate treating apparatus includes, a chamber configured to provide a substrate treating space therein;

a substrate support assembly configured to support the substrate, the substrate support assembly placed within the chamber;

a gas supply unit configured to supply a gas within the chamber;

a plasma generating unit configured to change the gas into a plasma state, the plasma generating unit including a high-frequency power source configured to supply high-frequency power; and a substrate temperature control unit configured to control a temperature of the substrate, and the substrate temperature control unit includes, a plurality of heating units placed on different areas of the substrate, the plurality of heating units each configured to control a temperature of the substrate on the different areas;

a power supply unit configured to provide power to control the temperature of the substrate;

a switch unit connected to the plurality of heating units and the power supply unit, the switch unit including one or more transistor devices;

a controller configured to control the power supplied to each of the plurality of heating units from the power supply unit by controlling the switch unit;

a first filter connected to the power supply unit and the switch unit, the first filter configured to block a high-frequency power signal from flowing into the power supply unit; and a second filter connected to the switch unit and the controller, the second filter configured to block a high-frequency power signal from flowing into the controller.

16. The method of claim 15, wherein the controlling the switch unit based on the temperature distribution information comprises:

determining an area of the substrate to provide the power from the power supply unit based on the temperature distribution information; and turning on at least one MOSFET channel corresponding to the determined area of the substrate.

17. The method of claim 15, wherein the controlling the switch unit based on the temperature distribution information comprises:

determining an area of the substrate to provide the power from the power supply unit based on the temperature distribution information;

applying a first MOSFET gate of a plurality of MOSFET gates, the first MOSFET gate corresponding to the determined area of the substrate; and applying at least one second signal to at least one second MOSFET gate of the plurality of MOSFET gates, the at least one second MOSFET gate corresponding to other areas of the substrate, the other areas of the substrate not including the determined area of the substrate.

* * * * *